US010096060B2

(12) United States Patent
Rabenold et al.

(10) Patent No.: US 10,096,060 B2
(45) Date of Patent: Oct. 9, 2018

(54) INTEREST GAUGE BASED AUCTION

(71) Applicant: Xcira, Inc., Tampa, FL (US)

(72) Inventors: Nancy J Rabenold, Brandon, FL (US); James A Simmons, Brandon, FL (US)

(73) Assignee: XCIRA, INC, Tampa, FL (US)

( * ) Notice: Subject to any disclaimer, the term of this patent is extended or adjusted under 35 U.S.C. 154(b) by 493 days.

(21) Appl. No.: 13/706,831

(22) Filed: Dec. 6, 2012

(65) Prior Publication Data

US 2014/0164162 A1 Jun. 12, 2014

(51) Int. Cl.
*G06Q 30/00* (2012.01)
*G06Q 30/08* (2012.01)

(52) U.S. Cl.
CPC ..... *G06Q 30/08* (2013.01)

(58) Field of Classification Search
CPC ..... G06Q 30/08
USPC ..... 705/26.3
See application file for complete search history.

(56) References Cited

U.S. PATENT DOCUMENTS 7,895,129 B2 * 2/2011 Phillips et al. ..... 705/330
8,230,362 B2 7/2012 Couch
2001/0039531 A1 * 11/2001 Aoki ..... 705/37
2003/0036964 A1 * 2/2003 Boyden et al. ..... 705/26
2003/0182222 A1 * 9/2003 Rotman et al. ..... 705/37
2005/0240507 A1 * 10/2005 Galen et al. ..... 705/37
2006/0149656 A1 * 7/2006 Chefalas et al. ..... 705/37
2007/0073553 A1 * 3/2007 Flinn et al. ..... 705/1
2008/0235113 A1 * 9/2008 Rabenold et al. ..... 705/27
2011/0087554 A1 * 4/2011 Roberts ..... 705/26.3

OTHER PUBLICATIONS

Preston McAfee et al. "Auctions and Bidding" Journal of Economic Literature vol. XXV (Jun. 1987), pp. 699-738.*
Paul Klemperer, "Auctions: Theory and Practice" © 2004 Princeton University Press, pp. 1-5.*

* cited by examiner

*Primary Examiner* — Naeem U Haq
(74) *Attorney, Agent, or Firm* — Smith Tempel Blaha LLC; Gregory Scott Smith; Carlos Julio Salas Martinez

(57) ABSTRACT

Information about participants in an auction are received and analyzed along with information about products to be auctioned and other information to generate an interest gauge. The interest gauge may reflect the interest of a buyer, a seller, an auction house or any other entity in the auctioning event. Based on the interest gauge, the operations of the auction can be augmented and/or modified to be optimal in view of revenue generation, products moved, and a balance between the two. For instance, the buyer interest gauge could be used to create packages of items to be auctioned in a combinatorial auction.

9 Claims, 5 Drawing Sheets

INTEREST GAUGE BASED AUCTION

CROSS-REFERENCE TO RELATED APPLICATIONS

This is a utility patent application being filed in the United States as a non-provisional application for patent under Title 35 U.S.C. § 100 et seq. and 37 C.F.R. § 1.53(b). This application incorporates the following applications herein by reference in their entirety:

U.S. Pat. Nos. 7,028,885 and 7,364,075, United States Patent Publication Number US 2006-0259392 A1, US 2008-0195523 A1 and US 2008-0195520 A1.

BACKGROUND

Connectivity has made our rather large planet seem as though "it's a small world after all". An individual can enter a single search in a web browser, pull up information related to the search query from all over the globe, place a telephone call to a company on the other side of the planet that was identified in the search results, and have a product shipped to his home with a confirmatory email sent to his computer all in a few sweeps and clicks of a mouse. Actions that used to take weeks worth of work can now be accomplished in just a few moments.

In view of the radical advancements in worldwide connectivity through mediums such as the World Wide Web, cellular infrastructure, etc., there remains a need in the art for the logistical implementation and integration of these capabilities into real-life scenarios. Often times, the lack of knowledge, understanding, and/or imagination can be a stumbling block for various business entities, market segments, and industries to fully comprehend and incorporate such technological advancements into their world and to fully reap the benefit of such advancements.

With the growth of the Internet and connectivity, the auction industry has been radically modified. An industry that was at one time limited to the noise and bustle of the auctioning floor in an auction house with the yipping of the auctioneer has been opened up to participants that remain in their office, or at home, or at another auction house while bidding and following items in an auction house half-way across the country. This has been accomplished by bringing the auction houses online such that a person can watch items and bid on items just as though he or she was standing in the lane.

Although great advancements have been made in the auctioning industry from the perspective of access or remote participation, little has been done to change the overall structure or operation of the auction process. More specifically, the great advancements in technology and connectivity that are available to help guide and run businesses in this age of connectivity and data warehousing have not been fully exploited to revolutionize the auction industry. As a result, much of the operation of auctions remains the same and auctions tend to be one-dimensionally focused. For example, in an auto auction, as each vehicle is brought into the lane, the auction house, the bidders, the auctioneer, etc., are all focused on that single car. The auctioneer is trying to find a buyer—he is scanning the audience and watching the bidders in an attempt to find an interest that can be leveraged to sell the current vehicle. The bidders are looking at the product and deciding if it would meet their particular needs for the particular moment, be it transportation, leasing, reselling, refurbishment, parts, etc.

One change that has been introduced into the auctioning industry is the use of combinatorial auctions. A combinatorial auction allows auction participants to bid on combinations of items or packages rather than just on individual items or continuous quantities. Examples of combinatorial auctions have been seen in estate auctions where items are bundled together. But other examples include truckload transportation, airline runway usage, radio spectrum, etc. Combinatorial auctions have several complications. One of the complications is how to efficiently determine the allocation once the bids have been submitted. However, another complication is how to sift through the available items to identify optimal bundles or packages for which participants can place bids. What is needed in the art is a solution that can beneficially exploit the advances in technology, connectivity, data warehousing, etc., to optimize auctions in efficiently moving items in a manner that benefits the sellers of products and or services as well as the consumer.

SUMMARY

Embodiments of an auction enhancement system improve the overall flow, functionality and efficiency of an auction by generating a buyer interest gauge and using the buyer interest gauge to augment the auction. More specifically, in one embodiment, a live auction can be directed by receiving profile information for a plurality of participating or potentially participating entities in an auctioning event. In addition, descriptive information pertaining to the items to be auctioned during the auctioning event is also obtained. The descriptive information pertaining to the items to be auctioned may be obtained from a condition evaluator or other sources of information. Based on the participant entity profile information for at least one participant entity and the descriptive information pertaining to at least one of the items to be auctioned, the auction process can be modified in a way that it would not normally be modified absent the participant entity profile information and the descriptive information.

The augmentation of the auction can take on a variety of forms. A few non-limiting examples include: identifying at least two items to offer together for auction based on the participant entity profile information; identifying ways to divide a product up and auction off parts; design a strategy to control the psychology of the auction, etc. The participant entity profile information can be in a variety of forms. Thus, modifying the auction process for a particular item may include combining one or more items together with the particular item to create one or more packages that include the particular item. The combinations are selected in anticipation of increasing the number of participating entities bidding on the particular item. As a non-limiting example, the information may identify parameters of a desired product to be acquired. In such an embodiment, modifying the auction process may include combining multiple items together that at least partially satisfy multiple parameters of the desired product. The combination of products for an auction may include any of a variety of actions, including combining multiple products and/or services such as packaging, shipping, etc. More specifically, if a service is packaged with other items in an auction, once the package is won, the third parties providing the service can be notified and provided with the information necessary for the third party to provide the services.

In some embodiments, the information may identify parameters such as: a value related to the cost per unit of item, a number related to a desired quantity of items, a value related to a desired delivery date, and a value related to the desired condition of the items; then the auction may be modified to combine items that at least partially satisfy one or more of these parameters. The action of combining multiple items together may include the application of algorithms to identify at least one package of items that has a greater likelihood of increasing the winning bid, the probability of a sale, or a combination of both.

The buyer interest gauge can be a dynamic measure that is constantly updated or a static measure that is calculated once and if updated at all or periodically. In the dynamic embodiments, the participant entity profile information may be stored in a database and the information in the participant entity profile is updated based at least in part on the activity occurring during the auction.

DETAILED DESCRIPTION OF VARIOUS EMBODIMENTS

Figure 1:
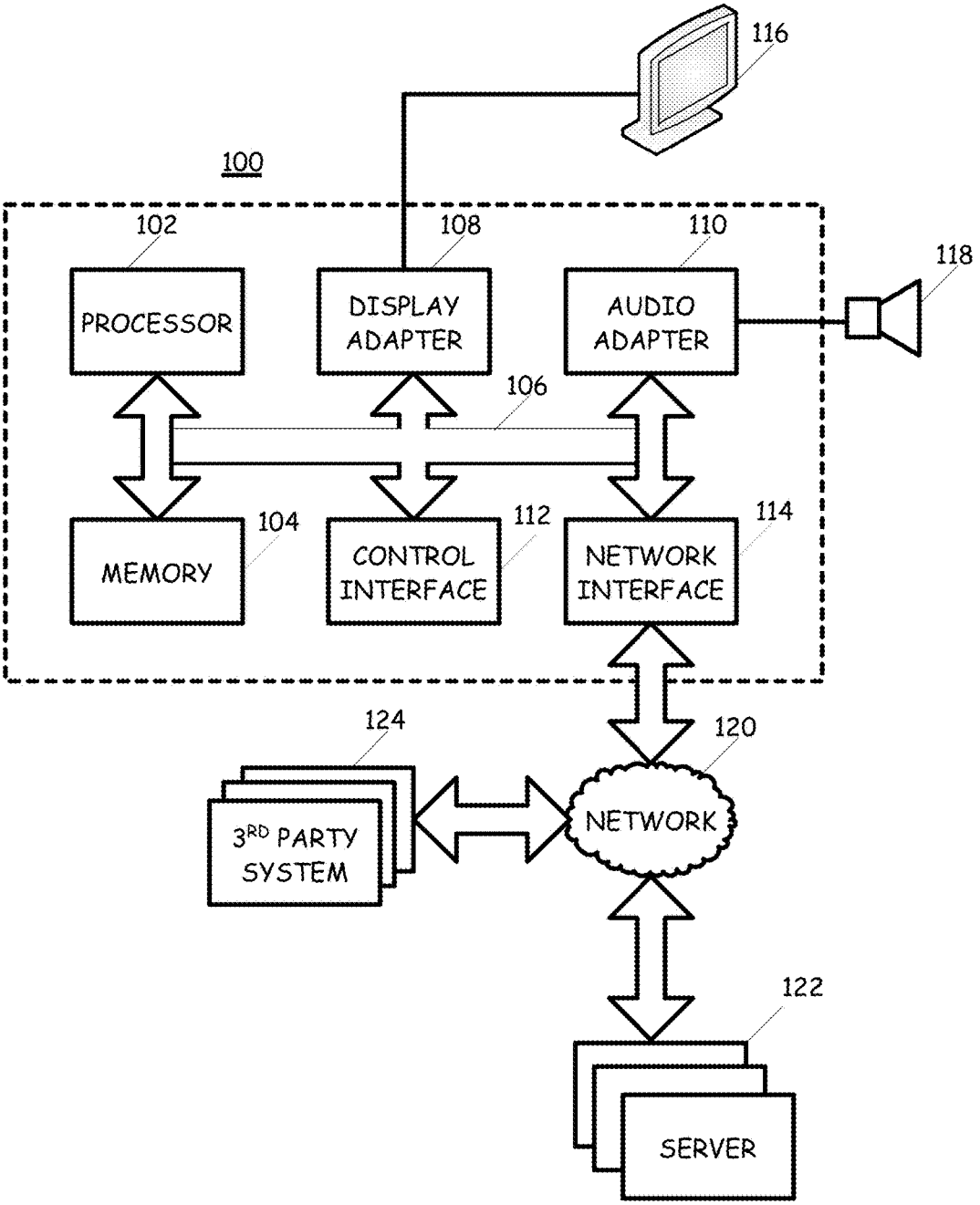
FIG. 1 is a functional block diagram of the components of an exemplary embodiment of system or sub-system operating as a controller or processor that could be used in various embodiments of the disclosure for controlling aspects of the various embodiments.

The present disclosure presents various embodiments, as well as features and aspects thereof, for the development, deployment and operation of a smart auctioning system that not only exploits the advancements in technological fields of computation, connectivity, and data accessibility but that also exploits the complexities of multi-dimensional auctioning through the use of combinatorial auctions. As such, the present disclosure presents various embodiments, as well as features and aspects thereof, of an improved auction management system ("AMS").

Two main elements are addressed in the various embodiments of the AMS presented herein: (a) assessment and evaluation of the needs of the participants and (b) the evaluation of the condition, features, advantages and other services and products related to various assets and the bundling of the assets in a manner that addresses the needs of the participants as well as maximizes the movement of and value received for product.

One aspect that may be included in various embodiments of the AMS is termed a Buyer Interest Gauge. The Buyer Interest Gauge provides a potential participant, such as a purchaser, a buyer, a bidder, etc., with an automated system and/or process for identifying, quantifying, qualifying, and providing an interest indicator based on various parameters related to not just the participant but also to the assets of interest as well as services and other assets that may be related thereto. The Buyer Interest Gauge can be utilized by a potential buyer, seller, consignor or other interested parties. Advantageously, the various embodiments facilitate the buyer's ability to understand his/her precise interest or benefit in purchasing a specific asset or groups of assets, based on his/her pre-defined/profiled needs, when assessed in view of a wide variety of other factors.

A few non-limiting examples of such factors may include the available inventory, the locations of the inventory, availability of inventory in lots, location, and sizes of the lots, the availability of transport for the inventory, aging of the inventory, source or manufacturer of the inventory, location of the buyer, destination location for the inventory, and other services and product related to the inventory such as packaging, testing, warehousing, etc.

In addition, with the Buyer Interest Gauge, a seller is better equipped to understand a potential purchaser's needs and interest and how better to market a product to that potential purchaser. For example, knowing that a customer needs a particular product, the ability to offer ancillary services related to the acquisition, delivery, processing, etc., of the product can be greatly advantageous. For instance, if a purchaser is turning away from a particular seller just because of the logistics in having the product delivered to the purchaser in a particular manner, the seller may have access to resources that can remedy any logistical hurdles that need to be overcome to make the purchase attractive to the potential buyer.

Even further, an auction house is uniquely situated to also take great advantage of the Buyer Interest Gauge by having knowledge of not only what the buyers interest is focused on but how that folds into the auction houses knowledge of what items and services are available to be offered or bundled with to create packages that can be bid upon in a combinatorial auction.

Another aspect or embodiment presented in the present disclosure is an automated system and/or process for providing "packaged" information to all of the participants of a transactional process, before and/or after the enactment of a transaction, such as but not limited to sellers, wholesalers, transporters, financers, etc.—typically but not always excluding buyers—but driven by the specific needs of the buyer.

Yet another aspect or embodiment presented in the present disclosure is an adaptive content management system that allows the seller (e.g., consignor/middleman) to manage the content of all technology components exercised in the fulfillment of a transaction based specifically on the need of the potential buyer. The content management system can be augmented by the employment of a decision architecture engine which operates to analyze the activity of a user or entity as presented or contained in the data warehouse and presents the content in a manner which optimizes the probability of a favorable reaction by the user.

Thus, one embodiment provides an automated process for providing a potential buyer with an understanding of his or her precise interest in purchasing a specific asset or groups of assets based on his or her pre-defined/profiled needs.

Turning now to the figures, the various embodiments of the AMS as well as features and elements thereof are presented in more detail.

FIG. 1 is a functional block diagram of the components of an exemplary embodiment of the system or sub-system operating as a controller or processor 100 that could be used in various embodiments of the disclosure for controlling aspects of the various embodiments. It will be appreciated that not all of the components illustrated in FIG. 1 are required in all embodiments of the activity monitor but each of the components are presented and described in conjunction with FIG. 1 to provide a complete and overall understanding of the components. Further, in some embodiments, additional components not illustrated may be added for particular interfaces and functionality. The controller can include a general computing platform 100 illustrated as including a processor/memory device 102/104 that may be integrated with each other or communicatively connected over a bus or similar interface 106. The processor 102 can be a variety of processor types including microprocessors, micro-controllers, programmable arrays, custom IC's, etc., and may also include single or multiple processors with or without accelerators or the like. The memory element of 104 may include a variety of structures, including but not limited to RAM, ROM, magnetic media, optical media, bubble memory, FLASH memory, EPROM, EEPROM, etc. The processor 102, or other components in the controller may also provide components such as a real-time clock, analog to digital convertors, digital to analog convertors, etc. The processor 102 also interfaces to a variety of elements including a control interface 112, a display adapter 108, an audio adapter 110, and network/device interface 114. The control interface 112 provides an interface to external controls, such as sensors, actuators, drawing heads, nozzles, cartridges, pressure actuators, leading mechanism, drums, step motors, a keyboard, a mouse, a pin pad, an audio activated device, as well as a variety of the many other available input and output devices or another computer or processing device or the like. The display adapter 108 can be used to drive a variety of user interface elements 116, such as display devices including an LED display, LCD display, one or more LEDs or other display devices. The audio adapter 110 interfaces to and drives another alert element 118, such as a speaker or speaker system, buzzer, bell, etc. The network/interface 114 may interface to a network 120 which may be any type of network including, but not limited to, the Internet, a global network, a wide area network, a local area network, a wired network, a wireless network, or any other network type including hybrids. Through the network 120, or even directly, the controller 100 can interface to other devices or computing platforms such as one or more servers 122 and/or third party systems 124. A battery or power source provides power for the controller 100.

Buyer Interest Gauge—Assessment and Evaluation of the Needs of the Participants

The buyer interest gauge can incorporate a wide array of information; but it will be appreciated that the more information that can be gathered, synthesized, analyzed, categorized, indexed and processed, the stronger, more reliable and more accurate the buyer interest gauge will be. The quality of the buyer interest gauge is impacted by the ability to fully integrate as many elements as possible that could impact the value and/or strategic nature of the transaction.

Figure 2:
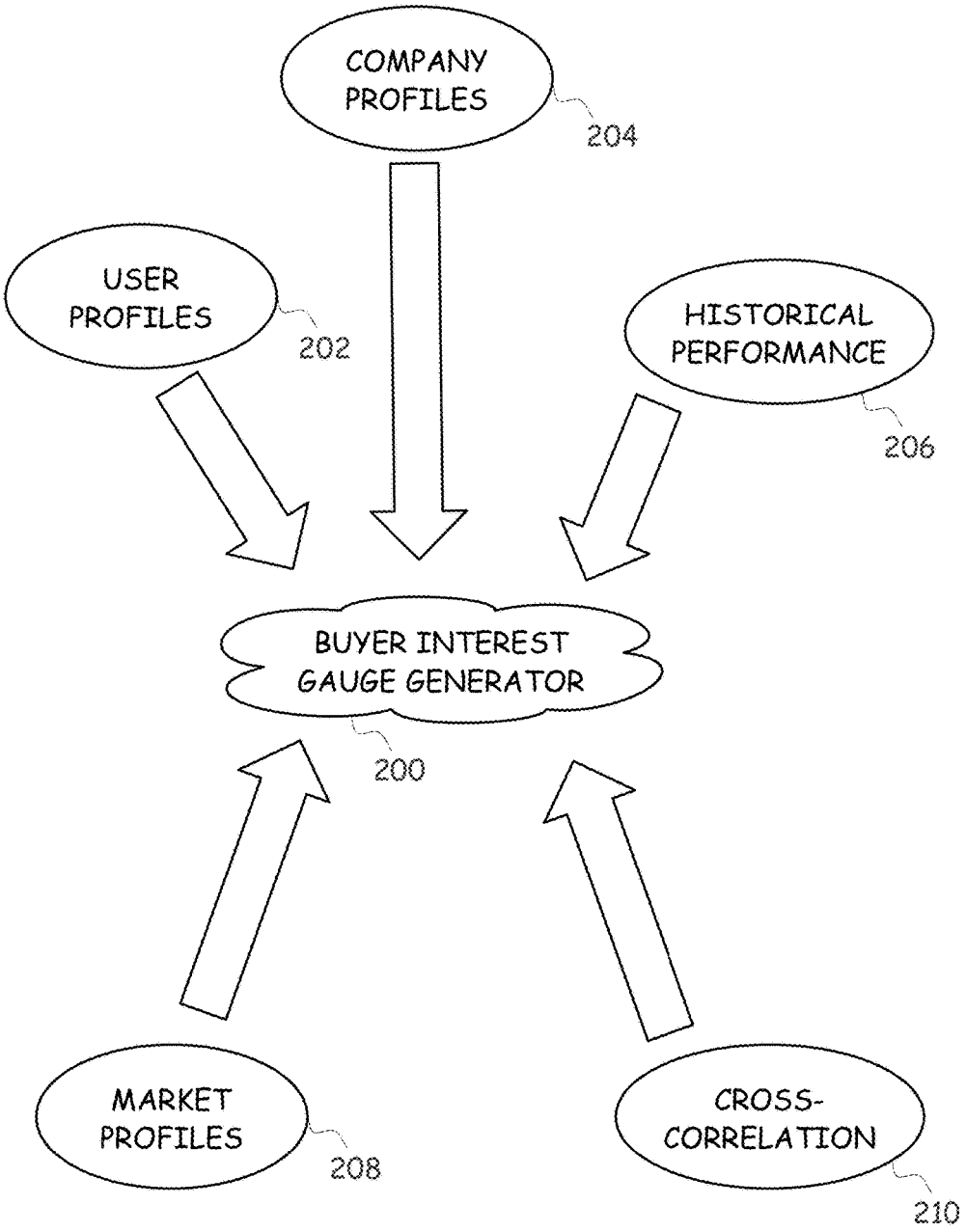
FIG. 2 is a functional block diagram illustrating an exemplary information integration that could be utilized for generating the buyer interest gauge.

FIG. 2 is a functional block diagram illustrating an exemplary information integration that could be utilized for generating the buyer interest gauge. A buyer interest gauge generator (BIGG) 200 operates as a central depository and brain center for soliciting, scraping, searching, requesting and otherwise obtaining information that can be used to create the buyer interest gauge. In the illustrated embodiment, the non-limiting examples of sources of information include user profiles 202, company profiles 204, historical performance 206, market profiles 208, and cross-correlation 210.

The user or buyer profiles 202 may include information that the user has provided by completing a questionnaire or online form that identifies particular wants, cost ranges, expected expenditures, budgets, etc. It will be appreciated that the amount and types of information provided in the user profiles 202 is basically limitless. The user could provide specifics regarding items that are being sought, generalities regarding desired items, categories or features that are or are not desired, amount of inventory that the user can absorb, the ability of the user to transport inventory, etc. The user profile 202 may reflect standard information such as business type, items sought, etc., market-specific asset needs, notification or alert preferences, etc. The user profiles 202 may also provide an indication of the finance approval ratings and cash-on-hand information about the user.

Similarly, the company profiles may include a wide variety of information. In some cases, the user profile 202 and the company profile 204 information may be one in the same; but in other embodiments, the company profiles 204 may be utilized to provide company specific information, such as number of customers, work-in-progress, current inventories, location of customers, particular needs of customers, etc. It will be appreciated that the user profiles 202 and the company profiles 204 may be provided by the user and/or company to the auction house (see element 430 of FIG. 4) or may be obtained by the auction house from other auction houses or other sources (see element 430 of FIG. 4). The buyer interest gauge generator may scrape information from a user's or a company's website, earnings reports, etc. (see element 425 of FIG. 4)

The historical performance 206 may include data that has been accumulated by the auction house as well as other auction houses, including online and at the house activities of the user and/or company. This information can be utilized to assess the types of purchases the user has been interested in in the past, the volumes of product, bidding habits, products, features, etc.

The market profiles 208 may include data pertinent to the particular market or business that the user of company is operating within. For instance, the user profiles and/or company profiles may be utilized to identify the particular market in which the user and/or company operate as well as characteristics of that market. The Buyer Interest Gauge Generator 200 can then pull information from other sources that provide market specific data that can help to characterize the buyer interest—for instance, product trending information, recall information, consumer report information, consumer interest index ratings, resale values, etc. The market profiles 208 may also take into consideration market-unique elements that could impact the value of an asset. For instance, by examining market information, the BIGG 200 can determine that a new product release may render an older version of the product obsolete and greatly diminish the price. As another non-limiting example, knowledge of a future price increase may increase current interest in the product that is on hand.

Cross-correlations 210 may also be performed by examining user and/or company profiles of similarly situated parties as well as comparison with the domain of products and services that are visible to the auction house. This information may be utilized to match up with user and/or company interest by utilizing information to augment certain products that may not appear attractive to a particular user and/or company but, when bundled or augmented, can become quite suitable to the user's needs. The cross-correlation 210 may also include accessing financial entities and, based on particular information known about the user or company, determine the risk associated with a particular user and/or company in actually taking delivery of items won in the auction and the quantities and expenditures that the user and/or company are estimated as being able to afford. The cross-correlations 210 may also look at the user/companies transportation capabilities as well as transportation resources known to the auction house that have capacity to move in the direction or vicinity of the user. The cross-correlations 210 may also take into consideration other participants in the auction and their needs and buying habits.

All of this information, as well as additional information, can be brought into the Buyer Interest Gauge Generator to generate a multi-faceted interest gauge that can be visually or electronically utilized to generate actions or suggestions on who and how to approach with regards to items and packages that are being offered for auction.

The Buyer Interest Gauge Generator (BIGG) 200 can be viewed as a data depository with adaptive and analytical capabilities. The BIGG 200 can be a static type machine that generates an interest gauge only periodically, such as at the beginning of an auctioning event; but preferably, the BIGG 200 is extremely dynamic with capabilities of providing feedback and updated interest gauges of relevant, up-to-the-second information in sub-second timing. For instance, as product is moving through the auction house, the buyer interest gauges may be modified significantly due to product movement, availability, recent purchases, etc.

It should be appreciated that the BIGG 200 may access any and all relevant data sources, including local data sources, cloud sources, industry sources, corporate warehouses, social media streams, etc. The BIGG 200 assimilates and processes all relevant data of different types including unstructured, semi-structured, structured, spatial data, raw data, etc. The BIGG 200 not only obtains the data through various means but also integrates and cleanses the data in preparing the data for analysis, indexing and searching.

Asset Knowledge

As previously mentioned, a second arm of the embodiments of the AMS is the evaluation of the condition, features, advantages, and other services and products related to various assets and the bundling of the assets in a manner that addresses the needs of the participants as well as maximizes the movement of and value received for product. This capability is being generally referred to as asset knowledge for the sake of brevity.

Figure 3:
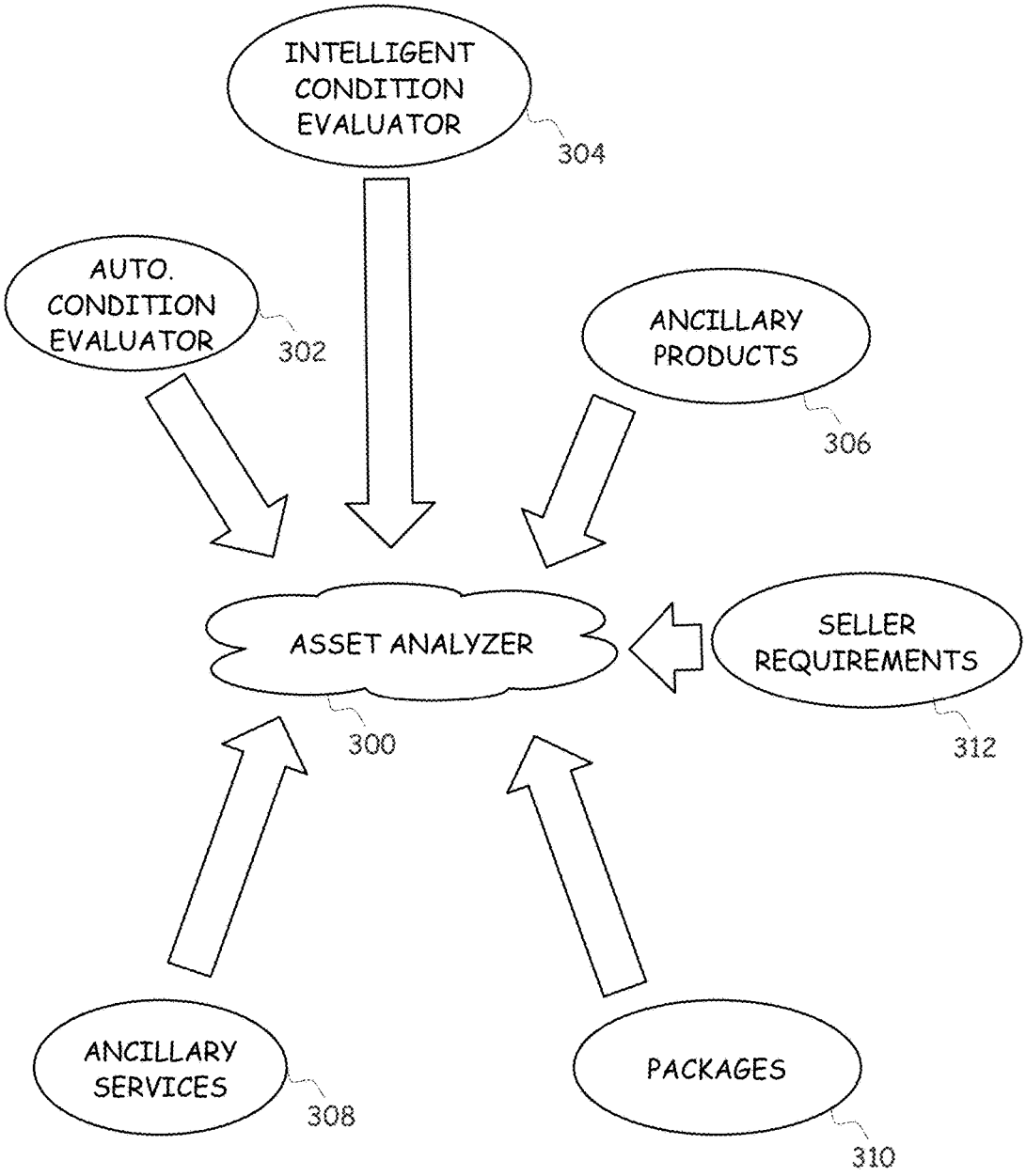
FIG. 3 is a functional block diagram illustrating an exemplary asset analyzer that could be utilized for obtaining and maintaining asset knowledge information.

FIG. 3 is a functional block diagram illustrating an exemplary asset analyzer that could be utilized for obtaining and maintaining asset knowledge information. The asset analyzer 300 is an exemplary server or computing environment for accessing and analyzing asset information. It should be appreciated that similar to the BIGG 200, the asset analyzer is simply a functional aspect of the various embodiment and although it may operate as an independently functioning system, it may also be incorporated into other systems and simply provide a generalized functionality. For instance, the BIGG 200 and the asset analyzer 300 may operate on the same single server in certain embodiments; and yet in other embodiments, each function may be distributed among several different servers. The asset analyzer 300 may take input or information from a variety of sources and FIG. 3 only provides a non-limiting example of some of the sources that could be relied upon in various embodiments.

One information source may include an automated condition evaluator or ACE 302. The ACE 302 provides a consistent, objective condition assessment for items and removes or diminishes the "human factor" from the evaluation. U.S. Pat. Nos. 7,028,885 and 7,364,075 provide good examples of an ACE 302 and are incorporated into this application by reference. As an example, the ACE 302 may provide information that is obtained with regards to its automated evaluation of the condition of an item. The ACE 302 could include an item evaluation chamber with an array of sensors that conduct various tests and evaluations of an item that is in a controlled environment.

More specifically, an item to be evaluated is first identified. The process of identifying an object includes subjecting the item to a preparation process. This process may include, among other things, the washing of the exterior and/or interior of the item to remove debris. In addition, any existing documentation regarding the item is entered into the system. For instance, if the item is a motor vehicle, such documentation could include warranties, previous sales orders, Vehicle Identification Number (VIN), maintenance records, and accident reports. Other items could include other information involving historical information regarding the item, certificates of authenticity, serial numbers, etc.

The information regarding the item is then processed and utilized to create, identify, and/or extract further information about the product. For instance, the VIN can be evaluated to identify particular information about a vehicle, access national databases regarding the history of the vehicle, and obtain manufacturer information regarding the vehicle.

Once the item is identified, either a pre-existing profile that matches the identification of the item is retrieved or a new profile is created. The profile is created using various techniques including, but not limited to, edge detection, lighting sources, and shading analysis. In addition, known options or configurations of the item are examined and compared to the actual item being evaluated. This can be accomplished by presenting a checklist to a human operator, querying historical databases based on the serial number of the item, or otherwise.

Data acquisition for the item is conducted to determine the condition of the item. The data acquisition is performed using a variety of different types of sensors and sensor inputs that are all evaluated by a central processor. As the data is being acquired, it is analyzed to identify any data abnormalities, glitches, or off-scale data points. If any abnormalities are discovered, the sensors can be reset, repositioned, calibrated, or otherwise adjusted prior to resuming or restarting the data acquisition process. In addition, historical records and databases can be interrogated to identify similar items that had similar abnormalities. Such information can be used to optimize sensor selection and adjustment for the detailed data acquisition activity.

Prior to completing the data acquisition phase, an interrogation of other industry sources is performed to define any potential problem areas. In addition, the present invention examines it own data depository for the purpose of identifying any potential problem area trends in similar items. Once any potential problem areas have been identified, the data regarding the item is re-evaluated to determine if it is necessary to acquire additional data from the potential problem areas. If it is necessary to re-acquire, the present invention will focus the proper sensor on the potential problem area and re-acquire detailed information.

Once the sensor inputs, abnormalities, and industry-available information have been acquired, the present invention will combine the various sensor inputs, industry trends, historical data, abnormalities, etc., into a condition assessment of the item which can be made available to decision makers. All sensor data will be added to the historical data depository for reference with future similar items.

Advantageously, the ACE 302 provides a consistent, objective, and reliable evaluation regarding the condition of an item. The evaluation can be used in a variety of settings to assist a party that must make a decision regarding the item. In particular, the advantages of the ACE 302 can be incorporated into various embodiments of the AMS and provide data input to the asset analyzer 300.

Another information source may include an intelligent condition evaluator ICE 304. The ICE operates to inspect items and generate an electronic inspection report. One aspect of the ICE is that the system has a repository of completed inspection reports and that the system mines the repository to determine correlations between fields of information in the completed inspection reports. Based upon the resulting field correlations, the system checks condition data as the inspector is recording it to determine and/or prevent erroneous data inputs.

Another aspect of the ICE is that it is scalable to inspect items from various different industries. Typically, the items from different industries are very unique such that a report template for an item from one industry is not appropriate for an item from another industry. The system is adapted to select the appropriate type of report template and provide the appropriate report template to a data collection device of an inspector. The system uses various criteria for determining the type of inspection report template to provide to the data collection device. The ICE 304 may also include information obtained from asset reference guides and information from other participating asset disposition venues. Further details regarding various aspects of the ICE can be obtained by examining United States Patent Publication Number 2006-0259392, which is incorporated into this application by reference. The information obtained from the ICE 304 can be provided as input to the asset analyzer 300.

Beyond, in addition or in lieu of the information obtained from the ACE 320 and/or the ICE 304 (and similar devices/systems which may be generically referred to as "condition evaluators"), additional information may also be obtained by examining other sources. This additional information may include market value of the asset, market availability, manufacturer information, colocation of supply, price trend analysis based on time, supply versus demand analysis, price impacting events and projected resale information.

The asset analyzer 300 may also receive information with regards to ancillary products 306. For instance, if one asset requires or is benefited by another asset, then the asset analyze 300 may consider this fact as a cross-selling point or may link the assets together. As a non-limiting example, if a lot of printers of a specific brand are going to be auctioned and the auction house is aware of a lot of printer cartridges that are compatible with the printers or a service contract (i.e., ancillary services 308) that would cover the printer that is going to be up for bid, then the asset analyzer 300 gathers this information.

With the information gathered with regards to the assets, the asset analyzer 300 may also receive input regarding potential packages 310 that could be formed in a combinatorial auction.

The asset analyzer 300 may also take into consideration any seller requirements 312 that may be available in seller profiles or other information similar to what is available for generating the buyer interest gauge to generate a seller interest gauge. The seller interest gauge can convey a variety of information such as the seller's motivation to move certain product, the willingness of the seller to discount product if it is contingent upon selling of other product, etc. A few non-limiting examples of information that can be seller specific include: wrapper provisioning for legislative needs, audit readiness, security and analytics, as well as other legal requirements that may be associated with the asset; a buyer rating system that identifies the ideal buyer or characteristics of a desired buyer that the seller is looking for; market price of the asset based on the condition of the asset, repair, and refurbishment return-on-investment for improving the assets, conversion or disposal costs of asset, etc.

Thus, it will be appreciated that the full integration of the BIGG 200 and the asset analyzer 300 into a framework allows for the creation and maintenance of a data warehouse and business analytics capability that can provide an improved level of business intelligence to the auction house, the bidder, and the consignor. Such an integrated system can provide a system that greatly improves the matching of auction items and packages to buyers and helps to drive optimum asset values.

Application of the Buyer Interest Gauge

It will be appreciated that the buyer interest gauge then gives a way for a buyer and/or seller to identify the value that a particular item, service, or group of items and/or services may be to a particular buyer, group of buyers, class of buyers, etc. By coupling the information obtained about the buyer with the condition information obtained from a condition evaluator or other sources of the item and/or service and then applying mathematical, heuristic, psychological and other rules and manipulations to the information, a buyer interest gauge can be determined that accurately reflects the value of the item and/or service to the buyer. This buyer interest gauge can then be used in a variety of manners. For instance, when a buyer turns on or accesses an online auction system, the buyer can be alerted that there are X items coming up in one or more auctions that, based on the buyer interest gauge for that buyer, may be of particular interest. The buyer interest gauge may be used to message or notify the buyer in a variety of manners, including the sending of emails, texts, alerts, telephone calls, postcards, etc., to inform a buyer or identify to a buyer certain products and/or services that may be of particular interest to the buyer based at least in part on the buyer interest gauge.

It should be appreciated that the buyer interest gauge is not merely the attachment of a number or indicator to an item to show the value, desirability, or quality of the item, but rather it is a combination of the information obtained about the buyer as previously described in view of an assessment of the condition and characteristics of the item and/or service, as well as packages thereof. The buyer interest gauge is a dynamic measurement that can change completely independent from changes in the condition of the item, the user profile information, etc.

As an example, the buyer interest gauge may be updated based on actions that recently occurred during an auction. For instance, the buyer interest gauge may indicate that the buyer should have a high interest in a certain group of products at the onset of the auction. However, based on the bidding actions of the buyer and items acquired during the auction, the buyer interest gauge for that buyer may be updated. As a result, the updated buyer interest gauge may indicate that the buyer would have little to no interest in that certain group of products. Thus, the buyer interest gauge is dynamic.

As another example, the buyer interest gauge may be updated completely independent from activities of the buyer and/or the condition of the items. For instance, if a hurricane or other force causes collateral damage, this could have an effect on the buyer interest gauge for various buyers. More specifically, if a buyer is an auto parts dealer and a hurricane invokes significant damage to a large number of vehicles, the buyer interest gauge may be affected, reflecting that a significant source of product may be available to such a buyer. In addition, if another buyer is a used car dealer, such an event may result in limiting the supply of product for the buyer and as such, the buyer interest gauge may reflect a higher interest for product currently available, knowing that a limited supply is around the corner. Thus, the buyer interest gauge is not only dynamic but also can change independently from the buyer and the item in some circumstances.

As previously mentioned, the buyer interest gauge can be used for identifying combinatorial options for an auction; for instance, items and/or services can be packaged together and the packages will run through the BIGG to generate the buyer interest gauge. The buyer interest gauge for such packages can be used as a determining factor as to whether or not the package should be offered up in a combinatorial auction. If it is determined that for a large number of potential buyers the average buyer interest gauge is high, then the seller or auction house may conclude that the package should be offered. However, if only a small number of potential buyers have a significant buyer interest gauge in the package, then the bidding for the package may be diminished and thus, of no interest to the seller(s) or auction house.

Figure 5:
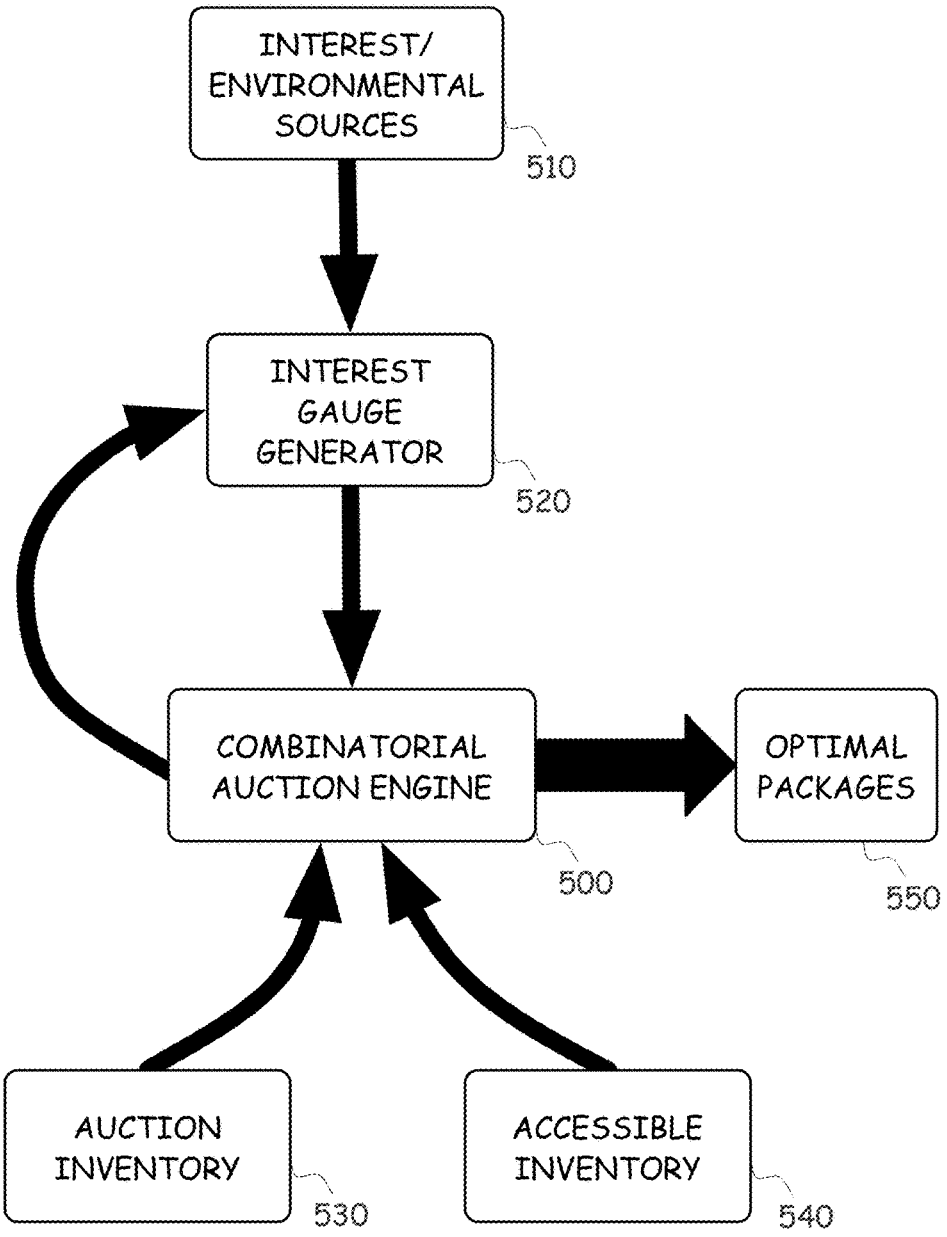
FIG. 5 is a block diagram illustrating an exemplary embodiment of a combinatorial auction engine that operates to control the input to an auction.

FIG. 5 is a block diagram illustrating an exemplary embodiment of a combinatorial auction engine that operates to control the input to and the operation and flow of an auction. The combinatorial auction engine 500 is shown as receiving input from at least two types of sources, interest/environmental sources and inventory sources. The interest gauge is generated based on a wide variety of information and the sources, weight and types of information can change from one embodiment to the other. In the illustrated general embodiment, the information obtained from the interest/environmental sources 510 is fed into the interest gauge generator (IGG) 520 to generate a variety of interest gauges (i.e., buyer interest gauge, seller interest gauge, auction house interest gauge, third party service provider interest gauge, etc.) for multiple users and/or classes of users and/or groupings of users etc. The combinatorial auction engine also receives inventory input for the current auction 530 as well as accessible inventory 540 that can be acquired, obtained, consigned, or otherwise utilized by the auction house and/or seller. Armed with this information as well as other potential information, the combinatorial auction engine can run through various permutations to identify packages that have optimum interest ratings or that will achieve optimum or desired results. As a non-limiting example, the combinatorial auction engine 500 may take a list of the auction inventory 530 and selected items from the accessible inventory 540 and generate permutations for packages. The permutations may be a brute force effort that covers all permutations of the available items or they may be intelligently assembled based on a variety of rules that can be customized per auction house, per buyer list, or by any of a variety of other factors. Thus, combinations such as toilet stools and knitting needles could be eliminated, if so desired. The various combinations can then be fed back through the IGG 520 to be combined with the information obtained from the interest/environmental sources 510 and generate interest gauges for each such combination across a wide range of buyers. The combinatorial auction engine can then apply heuristics to determine which packages should be offered to the auctioning public based at least in part on the interest gauges. For instance, having access to the totality of information, the IGG 520 may include logic that determines the optimal approach to take in an auction based on segments of the information or all of the information. Thus, although the IGG 520 is shown as generating optimal packages 550, the IGG 520 also may generate control information to identify actions such as the order in which items are to be offered, the starting bids, the bid increments, other psychological tactics to be applied, as well as looking at the totality of the circumstances in determining what and how to offer optimal packages. This can result in a highly dynamic auctioning environment that not only can be modified and tweaked to be optimal at a given point in time but that can be dynamically altered as the auction progresses. The IGG 520 can consider factors such as the demographics of the auction audience, current rates for particular items (i.e., fuel prices, scrap metal prices, etc.), other avenues or options for selling items, other options for potential acquirers for flipping items or portions of items acquired, etc. Thus, based on the variety of information provided into the system, items may be packaged, split, and/or re-ordered in the auction and otherwise offered differently to focus on particular goals or demands present at the current time. The particular presentment, combinations, etc., can be determined by looking at the whole picture and making judgments for the operation of the auction based on the particular goals or requirements. For instance, profitability requirements at a particular auction may be relaxed in the interest of moving inventory as a non-limiting example.

In addition, the buyer interest gauge can be utilized for reverse combinatorial auctions or splits. For example, if an auction has an inventory of used cars to be moved but the auction participants are primarily body parts and restoration companies, the combinatorial auction engine may also look for ways to split up the items in the inventory to maximize profit and/or moved items. For instance, for each of the non-usable, "totaled" automobiles, the engine, the glass, the panels, etc., could be auctioned separately. Thus, for each item that rolls into the lane, multiple auctions may take place either simultaneously or back-to-back. In addition, the combinatorial auction engine may produce packages that are a combination of splits and packages. For instance, all of the engines in one particular model may be packaged together, all of the engines may be packaged together, or engines may be packaged with certain tools. Thus, it will be appreciated that the combinatorial auction engine could be adapted to work in any of these scenarios.

Further, it should be appreciated that similar to the buyer interest gauge, a seller interest gauge may also be generated and utilized in various embodiments. The seller interest gauge may be an indication of a seller's motivation to sell or move a product. Such information could be useful for buyers in determining which items they should bid on and for auction houses in determining how best to move the product and package the product with other items. Thus, the seller interest gauge may include seller profile information such as the price being sought, the current inventory, the identification of other items the seller is looking to purchase and other items the seller is looking to sell, the aging of the product, the condition of the product, etc.

Thus, it will be appreciated that the buyer interest gauge, or in some embodiments simply an interest gauge, advantageously benefits all parties in an auctioning environment, allowing buyers to better know what to target, allowing auction houses and sellers to understand how to augment the auction by splits and combinatorial offerings, how to push the product, how to control the psychology of the auction, etc.

One advantage incorporated into the various embodiments is the integration of informational sources tailored to user-specific needs. This allows transactional values to be calculated, thereby eliminating decision illusion. For instance, bidders can be provided with access to a myriad of valuable data points, including but not limited to the following:

- Asset condition information—based on the needs of the segment—and the specific value to the potential user based on same;
- Assistance in determining market prices for items of interest involving expert search components;
- Locations of needed supply;
- Price trend analysis by time period;
- Supply-versus-demand analysis by time period;
- Projected resale information (price, time, cost, etc.) from retail versus wholesale demand, price, etc.;
- Alerts to "events" which may or tend to impact price and supply/demand;
- After-transaction services, including projected costs, vendor profiles, vendor satisfaction index ratings, service ratings, etc., associated with such activities as shipping/transportation, financing, insurance, repair, and post-auction inspection information;
- Notification/coordination with vendors for services; and
- Automated self-policing information (e.g., credit limits; institutional requests, etc.).

In addition, the sellers (e.g., consignors, etc.) and middlemen (e.g., auction houses, wholesalers, etc.) may also be provided with access to a myriad of valuable data points, including but not limited to the following:

- Status of the auction/sale with cradle-to-grave tracking of the asset during the disposition cycle;
- Assistance in establishing market prices for assigned items with respect to:
- Supply versus demand trends (30, 60, 90, 180, and 365 days);
- Disposition venue trends;
- Price differentials associated with the grouping of items ("smart" reserve pricing per item and real-time modification);
- Effects of external events on supply, demand, and price; and
- Trends on value with bundled services;
- "Want" and "need" list for push/pull marketing;
- Detailed asset information, including:
- Features/functions;
- Condition reports;
- Determination of asset's value to the potential buying pool based on condition;
- Configuration of catalog placement optimization or cross-venue offering;
- Integration into the seller's and middleman's (e.g., auction house, etc.) content management strategy;
- Customer "want" and "need" list for push/pull marketing;
- Configuration of catalog placement optimization;
- Trend identification regarding bidders/event/inventory;
- Asset interest indicator;
- Second highest bidder manipulation;
- "Bidding in the lane" manipulation;
- Integration into consignors' content management strategy; and
- Constantly changing auctioning platform—for all segments—that changes based on up-to-the-second market trending;
- System infrastructure display for staff review, including:
- User counts;
- User activity (e.g., bid counts);
- Performance scalability (e.g., network, clerk clicks, audio/video, etc.)

Customization of System—Auto-Learning

In various embodiments, a customization capability may allow the users of the platform to customize the format, look, data, organization, etc., of all components of the overall system. This capability may be implemented in a one-size-fits-one fashion to allow for greater consistency. For example, the system may accommodate user preferences relating to business, behavioral, and psychological needs/desires as well as maximized productivity. Each time a user customizes a component, the customization is captured and stored in the data warehouse for the advancement of a smart system. Thus, with each change or customization, the system grows smarter in its operation.

As a few non-limiting examples, the system may be provided with catalogs. The catalogs may include videos, pictures, etc. From a buyer's perspective, the catalogs may be used to establish current backlog of product and inventory needs. From a seller's perspective, the catalogs may be used to effectively and efficiently manage inventory as well as evaluate the integration of the handling of assets such as the grouping of goods. Furthermore, information can be provided regarding "wrappers" associated with government or compliance requirements including, but not limited to, legislation/association mandates/etc., audit-readiness, and analytics/metrics and security obligations.

The customization may also benefit the user interface level of various embodiments of the system by allowing for the personalized manipulation of elements (e.g., multi-lingual and multi-currency capabilities) for all aspects of system usage, through and including reporting. In addition, the customization may allow for settings to be set for interfaces for all users (e.g., buyers/bidders, consignors, and viewers). Thus, various embodiments may include: (a) fully developed customization options; (b) feature/function selection ease; (c) ergonomic design; (d) data conversion into information; (e) electronic "assistant" for information management (e.g., avatar); (f) entertainment; (g) reporting; (h) decision-making triggers; and (i) tailorable features that harness the power of people's natural tendencies to be attracted to things that remind them of themselves.

System Operation

In operation, the system allows the seller/consignor/middleman to manage the content of all technology components based specifically on the need of the potential buyer. Complementing the content management system, a decision architecture engine may be included to analyze the user's activity contained in the data warehouse and present the content in a manner that optimizes the probability of a favorable reaction by the user. One of many benefits realized by the seller from the use of such a system is the ability to "manage eyeballs", as more fully described below. Beyond the extensive decision-making capability, the implementation of such a content management system can also be leveraged to train, entertain, engage psychology, create conversions, allow for experimentation, etc.

Thus, in the various embodiments, the content management system should be proficient and persuasive in the promotion of conversions and in the management of all participants.

The content management system should be proficient in the promotion of conversions to benefit the seller/consignor/middleman in any one or a combination of the following ways:

- Increase sales
- Drive traffic to specific destination(s)
- Build a profile list of qualified prospects
- Increase online presence and exposure
- Gain credibility and influence as a thought leader Connect with existing clients
Validate a clear understanding of brand
Correlate respective visits to the company's web-site or interest in the company's services (e.g., OLR, etc.) from social media platforms
Satisfy requests for information
Solicit industry participation
Improve communications among customers and others in industry
Provide channel for invitations to speak or contribute to an event, blog, or other online platform
Receive unsolicited recommendations from the industry
Allow customers to evangelize on the company's behalf
Increase visits to company's trade show strategy due to social media exposure
Improve awareness of company's brand as noted by the sales staff
Improve awareness of company's brand as noted by media
Improve awareness of company's brand as noted by online measurement goals
Be recognized as a thought leader in a respective industry
Participate in online communities (or groups) started by company
Learn something meaningful about customers, market, competition, etc.
Position for noticeable positive sentiment in how company is perceived
Shorten sales cycles due to improved brand strength
Create more sales opportunities due to improved brand strength
Quantify and qualify traffic, buzz, leads, and sales
Understand and implement a predictable process (preferably through automation) that converts a user from one destination to the next—until ultimate goal(s) for that user are realized—within all aspects of the company
Determine the "value" of bidders in segment pools
Understand the value attributable to each click
Understand how to turn clicks into customers
Create community
Create a "real time" customer service program
Seek electronic content awards (e.g., service, website, blog, podcasts, etc.)

Furthermore, the content management system should be proficient in the management of all participants—or participant "eyeballs"—to allow the auction house or consignor to extend any one or a combination of the following to the auction participants:

Proactive monitoring of the health of users' systems
Automated transaction processing (e.g., once a bidder wins, the purchase amount would be automatically deducted—including handling fees, shipping, etc.—from user's credit card, bank account, retainer, etc.)
A buyer rating system based on credit risk (e.g., payment risk, timely pick-up, etc.) with bidder label categories (e.g., platinum, gold, silver, etc.), entitling the buyers to certain privileges
Flipping of items (e.g., buyer can post purchase directly to website, e-Bay, etc.) as further described in United States Publication Numbers US 2008-0195523 A1 and US 2008-0195520 A1 which are incorporated by reference above
Provision of information regarding alternative or additional items that the user may be interested in
Simplified registration process to allow registrants to enter directly into the auction, if desired
Self-policing qualifications (e.g., bidder always knows own credit limits; consumer knows what he can afford; bank-like valuation is provided, etc.).

The third element is the implementation of a persuasive conversion system that can be integrated into a prescribed framework and operate to provide services such as choreographing the seller's website, auction catalogs, customer service offerings/components, and integrating information from other similar sources (e.g., OnLine Ringman, XAP, ICE, etc.) so that the activity of the users can be fully understood and exploited, for instance, the information that identifies that User 123 viewed Item ABC a total of 14 times, spent 3 minutes on the detailed item page, and moved to the registration page, etc. Once information at this level of detail and specificity is added to the diagnostics derived from the enhancements detailed above, the reporting and analytics available to the auction house, the bidder, and the consignor can be utilized to have an impact on the behavioral characteristics in the psychology-driven auction business model and open up additional economic opportunities. It should be appreciated that conversion as described herein is part science and part art, and it relies to some extent on understanding the psychology and process of persuasion and adapting it to the online medium. Conversion should be viewed as a complex system, the success of which depends on the system's ability to address the varying levels of needs a user brings to the online experience.

To be effective, the system can address these user needs at every possible conversion point in the process. In some embodiments, it may be critical that the proper action be taken at the exact point of time action is required. When persuasive information is provided at the point when the customer's customers are getting ready to take an action, the greatest cognitive dissonance will be realized and the persuasion will have the most impact. The persuasion may be more effective if it follows the format of attention, interest, desire, action, and satisfaction. At the most fundamental level through and including the most advanced level, users are motivated by the question, "What's in it for me based on the value of the asset?"

In some embodiments, the persuasion of conversion is enhanced by administering one or more of the following:

Quantifying and qualify traffic/buzz/leads/sales
Implementing a predictable and automated process that converts a user on the website from one destination to the next—within all aspects of the website—until buying or selling is realized
Implementing a conversion strategy within customers' customer's content management plan, including social networking
Determining how much the participant is worth to the auction
Understanding the value attributable to each click
Understanding how to turn clicks into customers
Developing segment portals of "valued" bidders
Developing system capabilities that provide for psychological persuasion on an individual basis. It is critical that the auction house be able to control the conditions that exist at the specific time that decisions are being made.

Advantageously, the various embodiments allow the users of the system to benefit from an adaptive content management system that is perpetually fed by data intelligence. The data intelligence leverages "adaptive results" from user profiles, trends, and psychology. Thus, as items are sold, funds expended, intelligence information gathered (such as perceived interest by one or more participates, bidding activity for similar or related products, etc.), the system can adapt and push elements of the auction in a different direction based on the updated information.

Figure 4:
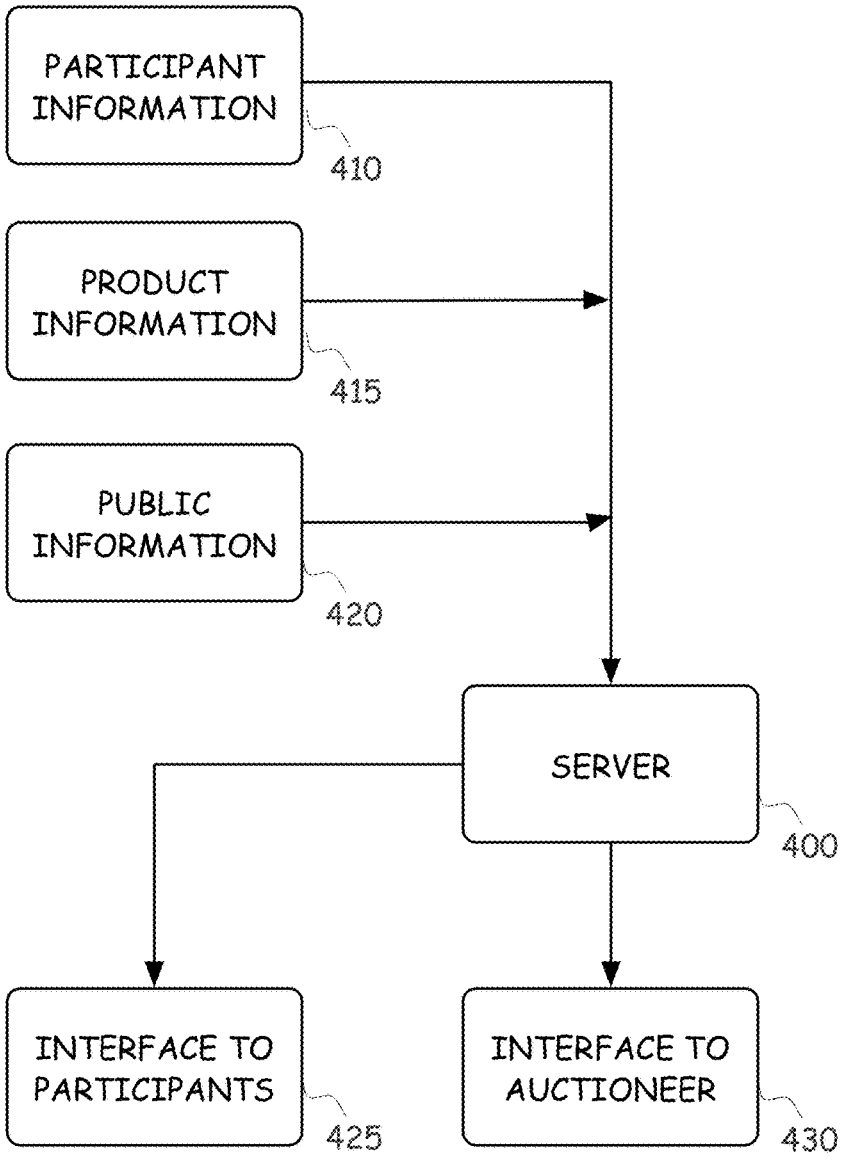
FIG. 4 is a block diagram illustrating the operation of an exemplary embodiment of the AMS.

FIG. 4 is a block diagram illustrating the operation of an exemplary embodiment of the AMS. A server 400, which may be a single server or multiple servers working in tandem, serves as the central processor or operations of the auctioning environment. The server 400 includes input from a variety of sources. The variety of sources has been grouped into three categories in the illustrated embodiment: (1) participant information 410, (b) product information 415, and (c) public information 420. The participant information 410 conforms to the various sources identified in FIG. 2 and includes bidder information and profiles as well as seller information and profiles. The product information 415 conforms to the various sources identified in FIG. 3 and includes information about the actual products or services being auctioned as well as the ancillary services and products that may be associated with the products or needed by the participants. The public information 420 may include information from a wide variety of sources that can be pulled in to facilitate the control of the psychology of the auctioning environment in any of a variety of manners as well as facilitate the identification of combinatorial auction packages that can be presented to participants to create the multi-dimensional auctioning environment.

As an example of the latter function, the server may search for, identify, and work out the arrangements for items (products and/or services) to be pulled in from other sources, including other auctions, which can then be presented in packages for bidding. For instance, if it is determined heuristically that a certain bidder or set of bidders would be drawn into participation, such items/services can be identified, obtained, or reserved and offered into the auction inventory as packaged items. For instance, in some embodiments, the server 400 may actively engage in the process of acquiring the items or services in anticipation that additional profit will be realized by the ultimate repackaging of the items or services within the current auctioning environment. For instance, if a fleet of passenger van vehicles are being auctioned and it is determined that multiple parties registered for the auction provide people transportation services, the AMS can pull a lot of parts that are suitable for the particular vehicles, advertising services that are available for increasing passenger takes, routes that can be purchased for transporting passengers, etc., and buddle one or more such items/services into a package with the fleet of vehicles.

Ancillary Services and Uses

Some embodiments of the AMS may include the provision of ancillary services. The combination of the processing power available with the auctioning system as well as the information that is gathered and utilized uniquely positions the AMS to provide such services.

Promotional Services

Some embodiments of the AMS may provide a variety of different promotional services. Given that content management is a set of processes and technologies that support the collection, managing, and publishing of information, it can serve to promote competitive differentiation. Therefore, company promotional announcements can be placed on product pages (e.g., executive announcements, new company offerings, company's positions concerning industry topics, etc.). For instance, on the general pages, the auctioning house can provide a variety of information, advertisements, promotional adds and offerings, etc., that are aimed at keeping the participant involved, informed about other options and ways to participate and/or improve the desired results, etc. In addition, as participants examine various products prior to commencement of the bidding on such products, the seller or company can provide other information about other products, that product, or advertising to further attract the participant or instill product desire.

Various embodiments may also utilize content management to promote market share growth by installing mechanisms that allow creative inquisition into the products or services in which audiences have an interest. Conversely, the operators of the AMS can be perceived as the industry expert that is recognized as "the" valuable resource in the decision-making processes of all participants in the marketplace.

Experimentation

The various embodiments utilizing such content management system also allow for the management and tracking of experimentation. Experimentation, in the general sense, is the ability to create controlled auctioning environments, although aspects may also be utilized and exploited during live, uncontrolled auctions in which operations of the system, the process, etc., can be controlled and tweaked and the reaction of the participants, flow of the auction and bidding, etc., can be monitored, tracked and analyzed to determine effective changes to the process that can maximize or increase profitability, product movement, number of successful sells, etc. In addition, the information that is gleamed from the experimentation can be directly infused into future auction runs to improve the efficiency, profitability, and utility of the auctions.

It will be appreciated that having participants engage in such experimentation and providing the feedback received during the experimentation in an easily understood, scientific manner can be extremely useful and beneficial for increasing the efficiency of the AMS and the auction results. The use of experimentation, in addition to increasing profits, may also encourage unique participation that results in a scientifically tracked return-on-investment. As an example, running a system in an experimental manner might include incorporating or structuring the auction as a "dutch auction". Dutch auctions have been scientifically proven to generate greater arousal than English auctions because the pressure to make one "correct" bid or risk losing the item is very motivating to ensure that a person bids what they are willing to pay, not what they want to push the seller to sell. Thus, in an experimental environment, such a change in the auctioning process can be run and observed. Even further, the actual items and sequences of the items in the auction can follow an actual auction that previously took place or is going to occur and, the results of the experimentation and the live auction can be viewed together to measure the effectiveness of the changes or tweaks that were made in the experimental use.

In an exemplary embodiment in which experimentation is provided, initially customer goals need to be established and approved. Once customer-approved goals have been established, the goals can be analyzed and then the experimental run can be modified, such as making product and process changes to align with customer goals. It should be appreciated that a wide variety of procedures and operations can be utilized in an experimental mode. Prior to conducting any type of experimentation, decision architecture can be established that allows for bidder decisions to be effected or influenced by controlling the conditions that exist prior to a decision being made—thereby psychologically impacting the way the participants behave. For instance, a few non-limiting examples of controls, benefits, uses or influences that can be utilized in an experimental environment include the following:

The experimental operation of an AMS can be used to scientifically research the value of multidimensional or combinatorial auctions wherein bidders bid not just on price but also on such underlying value drivers as: (a) transportation and delivery time, (b) financing, condition and evaluation rating, (c) warranty, etc.

In general, it can be stated that at least two design parameters affect the performance of the auction or at least impact it in some manner. These two design parameters are (1) the length of the auction and (2) information architecture. The length of the auction is self-explanatory—the length of time the floor is open on an item has an effect on the bidding of the item. It should also be appreciated that the "expected" length of the auction likewise has an effect. For instance, if bidders know that a cycle for an item is going to be on the order of seconds, they may be more likely to bid early and bid aggressively, whereas if the auction cycle is on the order of minutes, the bidding may move more slowly initially. The information architecture describes what type of information is available to whom, or when, and how it becomes available to whom during the market process. A market does not trade, but rather the traders of the market do. The traders exchange information in order to do this. Although various focal points exist, in exemplary embodiments the focus can be on the formal market rules (forming a key part of the information architecture) and the impact the market rules have on market performance. Five categories of informative elements may exist in an exemplary embodiment:

Bid elements—information regarding the bids themselves (actual bids), frequency of bids, size of bids, differential between bids, bid statistics such as mean increase, standard deviation, etc., and the decision whether to reveal bids, delay the publication or keep the bids secrets Bid scores—reveal the scores of a bid Bid rankings—reveal information about the relative ranking of the bid among all bids received Bid taker's style of incorporating bids into the process Bidder identities—choose the bidder information to be disclosed and when.

One concern with experimentation is that of information saturation. Beyond a certain point, more information does not necessarily improve market performance any further. The goal of a multidimensional or combinatorial auction includes the search for the bid taker's optimum bid, which is quite different from a single-dimensional auction where the emphasis is on beating the competition. The bidding process can be viewed in a multidimensional auction as a search for the bid taker's optimum, the bidder's belief corresponds to where he thinks the bid taker's optimum is located and he is assumed to bid accordingly. Using an electronic multidimensional auction in such cases can transform the win-lose nature of the buyer-seller relation in conventional price auctions into a win-win situation (or at least a win-reduced loss), leading to gains for all parties involved. As organizations become more customer oriented and customer preferences (e.g., the Buyer Interest Gauge) instead of producer capabilities become the starting point for a transaction, the traditional "availability" gets turned on its head and becomes a demand web where organizations compete to fulfill the demand of the customer. Coordinating this process through a win-lose mechanism such as a one-dimensional auction is only a stopgap measure. Consumer demand is multidimensional, and as such, a multidimensional auction environment is more ideal. To facilitate the promotion of this multidimensional auction environment and to allow participants to realize the reciprocal healthy ROI, it is advantageous if the results can be scientifically reproducible.

The embodiments of the AMS that include the experimentation function advantageously can allow for the exploitation of the bidder psychology with the information architecture and the decision architecture related to such information. As previously described, this allows the customer to affect decisions that need to be made by controlling the conditions that exist at the specific time that a decision needs to be made—thereby psychologically impacting the way the participant thinks and behaves. A few non-limiting examples of psychologically induced options that can be embedded into various embodiments of the AMS include the following:

Change the look and/or feel of the bidder interface 425 to be more appealing to solicit certain emotions or reactions, such as changing the message and/or color on a bid button, changing the color of the back ground, etc.

Provide the bidder with relevant information that is specifically tailored to him or her and the respective ROI based on the relevant information Leverage "relativity" or "means of comparison". For example, "What's hot?" type of information concerning what is selling on the used car lots and the average price per region. "You missed this car; but there is another similar model/condition as a 'buy now' listing for $X on XX platform." Or, explain the economies of scale associated with a bulk purchase (e.g., transportation, financing, etc.)

Send a pre-canned but personalized message to the bidder, thereby "inspiring" him/her to bid. For example, "It's almost yours . . . are you sure you want to give it up?" "This would be great addition to your inventory!" Or compare to an industry-standard price reference guide and send a message to reflect a potential ROI Incorporate one's "aversion to loss" psychology Allow a participant to see the asset in his inventory prior to purchase or during the purchase process Leverage a participant's sense of ownership through partial ownership logic. Starting the bidding low creates a sense of virtual ownership—early bidders think of themselves as owners. Start the bidding low—this leaves bidding participants in the vulnerable position to have strong feelings of virtual ownership; they think of themselves as owners—and feel compelled to prevent losing their position by bidding higher and higher. Psychologically speaking, the lower starting prices can actually lead to a higher final sale price for three reasons Lower starting prices encourage participation. Because the starting prices for auctions act somewhat like a barrier to entry, lower starting prices are better for encouraging participation by as many people as possible in the bidding process for an item Lower starting prices act as social proof for bidders. The increase in traffic—reflected in the total number of bids as well as the number of different bidders—afforded by these lower initial prices acts as social proof for new potential bidders. In other words, prospective bidders considering an item that started off at a low price would find social validation that the item is of value because so many more people were also bidding on the item, and this validation would spur them to bid on the item as well To justify the time and energy already spent in the bidding process, bidders are more likely to stay committed to winning ("virtual ownership"). Bidders for items with low starting prices, especially those who get in early, are likely to spend more time and effort updating their bids. In an effort to justify the time and energy they've already spent on the bidding process, these bidders are more likely to stay committed to winning the auction by continuing to bid and raising their bids even higher ("virtual ownership").

Those of ordinary skill in the relevant art will understand that the behavioral science community specifically understands "arousal" as a, if not "the", cause of auction fever. Arousal, a psychological state, can have complex effects on behavior and decisions of a bidder. The arousal (1) impacts decision making, and (2) increases interest and therefore bidding. There seems to be little that is rational about auction fever—even when bidders have perfect information, they will likely still overbid when they are influenced by intense emotions and arousal. Today, business leaders simply assume that decisions are made given an optimized bidder rationality with market-level measures and outcomes. With few exceptions, research in economics has presumed the same bidder rationality and has therefore focused its empirical analysis on market level measures and outcomes (e.g., efficiency, revenue generated, etc.). Arousal has thus become a decision-making phenomenon. This leads to the view that competitive arousal is a general decision-making phenomenon within the auction environment with considerable potential for broad applicability. An extensive amount of scientific experimentation has proven that arousal can hinder effective decision-making by restricting the capacity to stay focused or pay attention, decreasing message elaboration and attention to important information, and increasing reliance on previously considered information, simple decision rules, risk-taking, extreme judgments, and purchase intentions.

Bidding can create a palpable feeling of arousal. The following six points represent non-limiting examples of psychological impacts that can lead to arousal:

(1) Impact of escalation and competitive arousal on bidding behavior. Escalation and competitive arousal impact bidding behavior. For example, sunk costs cause bidders to invest more rather than rationally withdraw. Escalation of commitment stems from the psychological inability to ignore sunk (irrecoverable) costs; it suggests that initial investment followed by negative feedback pushes individuals to justify their previous decisions, leading them to invest more rather than to rationally withdraw. Also, investments beget more investments, even when continuing is unwise. Since people are motivated to view themselves positively, they try to avoid quitting, giving up, or admitting a mistake: investing more justifies their previous investments and provides hope of turning the tide. Self-justification is powerful and results in a positive self-image, even if bidding passes initial reservation prices. Since self-justification helps preserve a positive self-image, auction winners should feel that they have done well, even if they bid past their initial reservation prices. Finally, arousal restricts attentional capacity, leads to less deliberation and less information processing, and increased risk taking (2) Rivalry, time pressure and social facilitation. Competitive arousal elements such as rivalry, time pressure, and social facilitation (the presence of an audience, being in the spotlight, the first-mover advantage, etc.) also create an arousal. Traffic at an auction environment can be a key element to controlling the environment. For example, to probe how the buzz at an auction boosts the final price, it is advantageous to study how decreased traffic for a desirable product may affect the sale. Once this phenomenon is understood, it can be of great benefit to be able to turn it on and off. Producing low traffic at an ordinarily well-trafficked auction is one way to turn off the phenomenon. But before traffic can be squelched or decreased, there first must be a sufficient level of traffic to pull it off. The combination of high stakes and high time pressure lead to considerable arousal and significantly higher bids. Time pressure increases arousal and leads people to fall prey to their associated cognitive biases. Time pressure leads people to engage in fewer cognitive deliberations when they evaluate risky gambles.

(3) Positive Feedback Loop Between Arousal and Bidding. Several factors, such as the following non-limiting examples, may have a tendency to increase arousal at an auction: the thought of being in front of an audience, being under a strong spotlight, bidding on an item with a hyped description, bidding after a double shot of espresso, and simply being involved in the bidding process itself.

(4) Lower Starting Prices. Lower starting prices typically lead to more bids than higher starting prices. Starting with lower versus higher bids results in the following scenarios: (a) lowers barriers to entry to the bidding process and increases the number of involved bidders at the onset of the auction, (b) produces more sunk costs (e.g., time and energy) by getting bidders to put their foot in the door and have a perceived ownership of the product and (c) leads participants to infer greater value on the product by directly observing the increased bidding behavior, which further promotes participation resulting in herding behavior.

(5) The Anchor. Throughout all experimentation, an understanding of an "anchor" can be of significant importance. An "anchor" is a numeric value that influences subsequent numeric estimates and outcomes. When people make judgments, their final estimates are often assimilated to—that is, become more similar to—the initial anchor value. Anchors do not merely have intrapersonal, cognitive effects but can also catalyze social processes that transpire across individuals. It is thus important to understand how anchors influence interpersonal processes and how the interpersonal and intrapsychic interact. It is important to recognize, however, that low rather than high opening bids have a tendency to generate high selling prices, demonstrating a reversal of the anchoring effect. So, advantageously, embodiments of the present AMS can be utilized to influence the initial anchor to a higher value and as such create a greater willingness in bidders to move higher.

(6) Arousal Begets Interest. In auctioning environments, arousal can be misattributed as interest in an auction item. This misattribution of interest can then translate into more bidding. Auction bidders can attribute their emotional feelings of arousal to a cognitive construct, even when that arousal is primed independently from the auction (e.g., crossing the shaky suspension bridge, which is completely independent of a beautiful lady that may be nearby, may be much easier and accepting by the invoked arousal than it would be otherwise). The recollection or invocation of arousal in one setting influences interest and bidding in another setting. High arousal (e.g., recall and re-experience a particular competitive event in which one felt very aroused, stirred up, and excited) leads to significantly more bidding. Thus, the recollection of arousal in one setting influences interest and bidding in another setting. Participants having the choice to engage in counter-attitudinal advocacy demonstrated that a manipulation of arousal that was unrelated to either competition or auctions still resulted in greater interest in an auction item, which then produced more bidding. Successful bidders tend to be "happier" people than non-successful bidders. Science supports the escalation prediction that buyers would be happier and have fewer regrets than non-buyers. Also, buyers and non-buyers were just as likely to exceed their set limits, suggesting that the buyers' greater happiness was not simply a function of getting a good deal.

Manage content for fun. Another ancillary service is managing content for fun. For example, a game can be developed for the purpose of providing a familiarity of the auctioning system, for training, or simply for fun. For example, the game may allow for the collection of achievement points, which can be cashed in for: (a) a prestigious place on the auction company's leader board, (b) customer giveaways, (c) special giveaways (e.g., vehicles) that become labeled as status symbols, and (d) consignors' shirts/hats/clothing for avatars.

Fantasy-League-like-games allow participants to win points for bids, purchases, and estimated hammer prices. Competition among other "Fantasy" leaguers for virtual items would be compelling while always subliminally promoting the company.

In the various embodiments presented herein, it should be appreciated that certain features and/or aspects may be incorporated into one or more of the embodiments and, each embodiment may use a configuration of any number of such features and/or aspects, including none or all of the ones identified herein, as well as others. A few non-limiting examples of such features and/or aspects include:

Deployment within one or more mobile devices

Deployment within mobile devices with audio and video capabilities

Multi-lingual support (Chinese/multi-byte, Russian, Arabic, etc.)

Multi-currency

Scalability

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A computer-implemented method for dynamically adjusting and directing a live auction with machine-generated communications, the method comprising the actions of:

a server generating a buyer interest gauge for each of a plurality of participant entities that are anticipated to participate in an auctioning event, each buyer interest gauge being based at least in part on participant entity profile information for each participant entity, the profile information for each of the plurality of participant entities including one or more of the following elements: financial status of the participant entity, quantity needs of the participant entity, product types being sought by the participant entity, condition requirements of products desired by the participant entity, a physical location to which the participant entity will have products sent, and the type of business in which the participant entity is engaged, wherein the server obtains the at least a portion of the profile information by executing an algorithm to query webpage content on the Internet that contains information associated with a particular participant entity and scraping information from the webpage content that is related to the particular participant entity;

the server executing a second algorithm to query descriptive information pertaining to a plurality of items to be auctioned during the auctioning event, the descriptive information comprising a condition evaluation of the plurality of items obtained by the server interfacing to an automated condition evaluator, an inventory of the plurality of items obtained by the server interfacing to an auctioning system, a physical location of each of the plurality of items, a listing of other products that are typically utilized in conjunction with the plurality of items, and a listing of services that are typically sought in connection with the plurality of items;

the server generating a seller interest gauge for each seller participating in the auctioning event, each seller interest gauge being based at least in part on a seller's inventory of a particular item of the plurality of items and the value that the seller is seeking for the particular items; and the server modifying the auction process by:

identifying combinations of the plurality of items based at least in part on the descriptive information pertaining to the plurality of items to be auctioned in the auctioning event, the buyer interest gauge for each of the plurality of participant entities and each of the seller interest gauges; and interfacing to the auctioning system to cause the auctioning system to present a particular combination for bidding during the auctioning event if the buyer interest gauges indicate that more participant entities would bid on the particular combination rather than a different combination or the items individually.

2. The computer-implemented method of claim 1, wherein the services that are typically sought in connection with the plurality of items include shipping logistics, and the action of identifying combinations of the plurality of items comprises the inclusion of packaging and shipping services for the particular combination.

3. The computer-implemented method of claim 2, wherein the action of the server generating the buyer interest gauges further comprises the server obtaining parameters from the user profiles for each participating entity including one or more of the following: a value related to the cost per unit of item, a number related to a desired quantity of items, a value related to a desired delivery date, and a value related to a desired condition of the items; and the action of modifying identifying combinations of the plurality of items further comprises combining multiple items together that at least partially satisfy one or more of the parameters.

4. The computer-implemented method of claim 3, wherein at least one of the multiple items is a service provided by a third party and the computer-implemented method further comprises an action of notifying the third party upon the participant entity winning an auction bid.

5. The computer-implemented method of claim 4, wherein the action of notifying the third party comprises providing information necessary for the third party to provide the services.

6. The computer-implemented method of claim 3, wherein the participant entity profile information is stored in a database and the computer-implemented method further comprises an action of augmenting the information in the participant entity profile information based at least in part on activity occurring during the auction.

7. The computer-implemented method of claim 1, wherein the action of the server obtaining descriptive information pertaining to a plurality of items to be auctioned during the auctioning event comprises receiving descriptive information for at least one item that was obtained from the automated condition evaluator.

8. The computer-implemented method of claim 1, wherein the participant entity profile information is stored in a database and the computer-implemented method further comprises an action of augmenting the information in the participant entity profile information based at least in part on the activity occurring during the auction.

9. A computer-implemented auction system comprising:

a first machine readable data source containing participant entity profile information for a plurality of participant entities that are anticipated to participate in an auctioning event, the first machine readable data source existing on a network accessible system;

a second machine readable data source containing descriptive information pertaining to a plurality of items to be auctioned during the auctioning event, the second machine readable data source existing on a network accessible system; and a server communicatively coupled to the first machine readable data source and the second machine readable data source over a network and configured to modify the auctioning event based at least in part on information received from the first machine readable data source and the second machine readable data source by:

generating a buyer interest gauge for each of a plurality of participant entities that are anticipated to participate in an auctioning event, each buyer interest gauge being based at least in part on participant entity profile information for each participant entity, the profile information for each of the plurality of participant entities including one or more of the following elements: financial status of the participant entity, quantity needs of the participant entity, product types being sought by the participant entity, condition requirements of products desired by the participant entity, a physical location to which the participant entity will have products sent and the type of business in which the participant entity is engaged, wherein at least a portion of the profile information is obtained by the server executing an algorithm to query and scrape a website associated with either the machine readable first data source or the second machine readable data source over the network;

obtaining descriptive information pertaining to a plurality of items to be auctioned during the auctioning event, the descriptive information comprising a condition evaluation of the plurality of items, an inventory of the plurality of items, a physical location of each of the plurality of items, a listing of other products that are typically utilized in conjunction with the plurality of items, and a listing of services that are typically sought in connection with the plurality of items, wherein at least a portion of the descriptive information is obtained by the server executing an algorithm to query and scrape a website associated with either the first machine readable data source or the second machine readable data source over the network;

generating a seller interest gauge for each seller participating in the auctioning event, each seller interest gauge being based at least in part on a seller's inventory of a particular item of the plurality of items and the value that the seller is seeking for the particular items;

accessing the inventory of an auction site and identifying combinations of the plurality of items to be auctioned based at least in part on the descriptive information pertaining to the plurality of items to be auctioned in the auctioning event and each of the seller interest gauges; and causing an auctioning system hosting the auctioning event to offer a particular combination for bidding during the auctioning event if the buyer interest gauges indicate that more participant entities would bid on the particular combination rather than a different combination or the items individually.

* * * * *